United States Patent [19]

Mizutani et al.

[11] 4,140,647

[45] Feb. 20, 1979

[54] DETERGENT COMPOSITION

[75] Inventors: Hiroshi Mizutani, Yachiyo; Mikio Kanno, Tokyo; Masaru Tamura, Sakura, all of Japan

[73] Assignee: Kao Soap Co., Ltd., Tokyo, Japan

[21] Appl. No.: 785,589

[22] Filed: Apr. 7, 1977

[30] Foreign Application Priority Data

May 11, 1976 [JP] Japan ..... 51-53684

[51] Int. Cl.[2] ..... C11D 1/83; C11D 3/36

[52] U.S. Cl. ..... 252/89 R; 134/40; 252/DIG. 1; 252/135; 252/156; 252/529; 252/535; 252/540

[58] Field of Search ..... 252/135, 529, 535, 540, 252/156, 89, DIG. 1; 134/40; 260/950

[56] References Cited

U.S. PATENT DOCUMENTS

| | | | |
|---|---|---|---|
| 2,704,278 | 3/1955 | Gamrath | 252/89 |
| 3,061,506 | 10/1962 | Nunn, Jr. | 269/950 |
| 3,294,693 | 12/1966 | Dupre | 252/135 |
| 3,574,524 | 4/1971 | Hershfeld | 252/156 |

*Primary Examiner*—George F. Lesmes
*Assistant Examiner*—E. Rollins Buffalow
*Attorney, Agent, or Firm*—Blanchard, Flynn, Thiel, Boutell & Tanis

[57] ABSTRACT

A detergent composition for cleaning viscous or solid organic soil and stains from surfaces comprising an organic phosphoric acid ester, an alkaline material and an anionic or non-ionic surfactant.

11 Claims, No Drawings

DETERGENT COMPOSITION

BACKGROUND OF THE INVENTION

1. Field of the Invention

The present invention relates to a detergent composition.

It is a primary object of the present invention to provide a detergent composition which is effective to remove, rapidly and completely, viscous or solid soils and stains in houses, especially soils and stains of scattered cooking oils in kitchens and the surrounding areas, soils and stains containing petroleum products such as kerosene, gasoline and automobile engine oils, and soils and stains composed of waxes and polishing agents used for cleaning and polishing floors, furnitures, shoes and cars.

2. Description of the Prior Art

Soils and stains composed of edible oils and fats, soils and stains composed of liquid petroleum fractions and tar and soils and stains of aged films of polishing agents composed of natural or synthetic waxes or synthetic resins can easily be removed by conventional mild detergents containing a surface active agent and a mild alkaline agent, if these soils and stains are in a relatively fresh state. However, when these soils and stains are exposed to the actions of light, heat, oxygen and/or drying for a long time, the components of the soils and stains are altered and their removal becomes very difficult. Detergents containing a strong alkaline agent, a solvent and the like are used for removing such aged soils and stains, but the results are not always satisfactory.

SUMMARY OF THE INVENTION

The present invention provides a detergent composition possessing excellent detergency and excellent ease of removing viscous or solid soils and stains formed by deterioration, oxidation and polymerization of oils, fats and tars and aged films of waxes.

More specifically, in accordance with the present invention, there is provided a detergent composition comprising as critical components (A) from 0.1 to 10% by weight of an organic phosphoric acid ester having the formula (I):

$$O = P\text{-}O\text{—}(CH_2CH_2O)_nC_mH_{2m+1}]_3 \quad (I)$$

wherein n is 1, 2 or 3 and m is 2, 3 or 4, or mixtures thereof, (B) from 0.1 to 20% by weight of ammonia or an alkanolamine having the formula (II):

$$NH_{n'}(C_{m'}H_{2m'}OH)_{3-n'} \quad (II)$$

wherein n' is zero or an integer of from one to 3 and m' is 2 or 3, an inorganic alkaline agent or mixtures thereof and (C) from 0.1 to 10% by weight of an anionic or non-ionic surface active agent or mixtures thereof.

Because of the synergistic action of the above three components, this detergent composition is capable of permeating into oily soils or waxy films and the detergent composition exhibits activities of swelling, softening, plasticizing, emulsifying and dispersing these oily soils or waxy films. Therefore, the detergent composition of the present invention has a very excellent effect of removing these oily soils or waxy films from various surfaces.

As preferred examples of the organic phosphoric acid ester (A) of the above formula (I) that is used in the present invention, there can be mentioned tris-2-butoxyethyl phosphate, tris-2(2-butoxyethoxy)ethyl phosphate, tris-2-propoxyethyl phosphate, and tris-2(propoxyethoxyethoxy)ethyl phosphate. As preferred examples of the alkanolamine of the formula (II) or the inorganic alkaline agent (B), there can be mentioned monoethanolamine, diethanolamine, triethanolamine, monoisopropanolamine, diisopropanolamine, triisopropanolamine, ammonia, alkali metal hydroxide (sodium hydroxide, potassium hydroxide), alkali metal polyphosphate (sodium polyphosphate), alkali metal silicate (sodium silicate), alkali metal metasilicate (sodium metasilicate), alkali metal carbonate (sodium carbonate), alkali metal phosphate and mixtures thereof. As the surface active agent (C) for emulsifying and dispersing soils which have been swollen, softened and decomposed by the organic phosphoric acid ester and alkaline agent into a washing liquor to promote the washing effect, there can be used, for example, anionic surface active agents such as olefin sulfonates ($C_{10}\sim C_{20}$), alkyl ($C_{10}\sim C_{20}$) sulfates, alkane sulfonates ($C_{10}\sim C_{20}$), alkylbenzene sulfonates having an alkyl of $C_8\sim C_{10}$ and alkyl ether sulfates having $C_{10}\sim C_{20}$ alkyl and 1 to 10 moles of ethylene oxide, and non-ionic surface active agents such as polyoxyethylene nonyl phenyl ethers and polyoxyethylene dodecyl phenyl ethers in which the number of moles of added ethylene oxide units is from 4 to 20, n-, iso- and sec-higher alcohol ethers of polyoxyethylene having an alkyl chain length of 10 to 18 carbon atoms and 4~20 ethylene oxide units and fatty acid ethanolamides and propanolamides having 10 to 18 carbon atoms. Ingredients (B) and (C) are water-soluble.

Typical mixing ratios of the three critical components for (1) the concentrated type detergent composition (to be used after dilution with water), and (2) the directly usable type (to be used as it is) are as follows:

| Components | Mixing Ratios (% by weight) | |
|---|---|---|
| | Type (1) | Type (2) |
| Organic phosphoric acid ester (A) | 1 - 10 | 0.1 - 10 |
| Alkaline agent (B) | 1 - 20 | 0.1 - 1.0 |
| Surface active agent (C) | 0.1 - 10 | 0.1 - 0.5 |

The detergent composition of the present invention can optionally contain auxiliary components such as those mentioned below.

A lower alkyl cellosolve or carbitol having 1 to 4 carbon atoms in the alkyl group can be incorporated in an amount of 1 to 10 wt.%. This component promotes dissolution of the organic phosphoric acid ester in the washing liquor and promotes swelling and removal of soil. A polyhydric alcohol such as propylene glycol, ethylene glycol, diethylene glycol or glycerin, an alcohol such as ethanol or isopropanol, or a lower alkylbenzene sulfonic acid salt such as a p-toluene sulfonic acid or xylene sulfonic acid salt can be added as a hydrotropic agent in an amount of from 0.5 to 5 wt.%. A silicic acid salt or phosphoric acid salt can be added as a metal corrosion inhibitor in an amount of 0.1 to 1 wt.%. Still further, small amounts of pigments, dyes and perfumes can be incorporated into the detergent composition of the present invention, if desired.

The balance of the composition consists essentially of water.

The present invention will now be further described by reference to the following illustrative Examples, in which all references "%" and "parts" are by weight.

EXAMPLE 1

Oily soils generated and deposited in galleys and kitchens are composed of frying oils, salad oils, fish oils, butter and the like, that are scattered during cooking. They have undergone oxidation and polymerization and they have a viscous or solid state depending on the degree of deterioration that has occurred.

A viscous oil formed by heating a frying oil at about 200° C. for about 20 hours was used as a specimen soil in the experiment described below.

The viscous oil prepared by the above method was coated on an iron plate and was allowed to stand for several days. In a wear tester, a lead weight of 1 Kg was placed on the top face of a sponge having a lower face area of 5 cm × 7 cm, 5 cc of a 10% aqueous solution of a sample detergent (having the composition indicated in Table 1) was impregnated into the sponge, and the above oil-contaminated iron plate was frictionally rubbed by this sponge. The number of frictional rubbings necessary for peeling off the oil film from the iron plate was measured. A lower number of the frictional rubbings indicates a higher washing effect.

The results obtained are shown in Table 1.

Table 1

| Components (%) | A | B | C | D | E | F | G | Commercially Available Product |
|---|---|---|---|---|---|---|---|---|
| tris-2(2-propoxy-ethoxy)ethyl phosphate | 2 | — | — | — | — | 2 | 2 | — |
| tris-2(2-butoxy-ethoxy)ethyl phosphate | — | 2 | — | — | — | — | — | — |
| tris-2(2-ethoxy-ethoxy)ethyl phosphate | — | — | 2 | — | — | — | 13 | — |
| tris-2)2-methoxy-ethoxy)ethyl phosphate (control) | — | — | — | 2 | — | — | — | — |
| ammonia | 1 | 1 | 1 | 1 | 1 | — | 1 | — |
| polyoxyethylene (9 moles) nonyl phenyl ether | 5 | 5 | 5 | 5 | 5 | 5 | — | — |
| ethyl cellosolve | 2 | 2 | 2 | 2 | 2 | 2 | 2 | — |
| water | 90 | 90 | 90 | 90 | 92 | 91 | 95 | — |
| Number of Frictional Rubbings | 12 | 10 | 15 | 40 | 50 | 65 | 55 | 30 |

From the results shown in Table 1, it is seen that the detergents of the present invention (samples A, B and C) are greatly improved in comparison with the commercially available product. It also is seen that the comparative detergent compositions, which do not contain one of the critical components, according to the invention, are insufficient in the washing activity.

EXAMPLE 2

A floor polishing agent is composed mainly of a wax and a copolymer of styrene and acrylic monomer. If a long time has passed since this polishing agent was coated on a floor, removal of the polishing agent becomes very difficult.

A commercially available floor polishing agent (resin-wax type) was coated on a plastic tile and allowed to stand for 1 month. The washing test was carried out in the same manner as described in Example 1, except that the concentration of the washing liquor was changed to 5%. The results obtained are shown in Table 2.

Table 2

| Components (%) | H | I | J | K | L | M | Commercially Available Product |
|---|---|---|---|---|---|---|---|
| tris-2-butoxyethyl phosphate | 4 | — | — | — | 4 | — | — |
| tris-2-propoxyethyl phosphate | — | 4 | — | — | — | — | — |
| tris-ethoxyethyl phosphate | — | — | 4 | — | — | — | — |
| tris-ethyl phosphate (control) | — | — | — | 4 | — | — | — |
| monoethanol amine | 5 | 5 | 5 | 5 | — | 5 | — |
| polyoxyethylene (9 moles) lauryl ether | 2 | 2 | 2 | 2 | 2 | 2 | — |
| sodium alkylbenzene sulfonate | 1 | 1 | 1 | 1 | 1 | 1 | — |
| butyl cellosolve | 5 | 5 | 5 | 5 | 5 | 5 | — |
| water | 83 | 83 | 83 | 83 | 88 | 87 | — |
| Number of Frictional Rubbings | 15 | 17 | 20 | 40 | 55 | 50 | 35 |

As will be apparent from the above results, the detergents of the present invention (samples H, I and J) are highly superior to the comparative detergents and the commercially available product with respect to their washing activity to soils of the floor polishing agent.

The embodiments of the invention in which an exclusive property or privilege is claimed are defined as follows:

1. A detergent composition consisting essentially of (A) from 0.01 to 10% by weight of an organic phosphoric acid ester having the formula (I), or mixtures thereof:

$$O = P\text{-}[O\text{-}(CH_2CH_2O)_nC_mH_{2m+1}]_3 \quad (I)$$

wherein n is 1, 2 or 3 and m is 2, 3 or 4, (B) from 0.1 to 20% by weight of ammonia or alkanolamine having the formula (II):

$$NH_{n'}(C_{m'}H_{2m'}OH)_{3-n'} \quad (II)$$

wherein n' is zero or an integer of from one to 3 and m' is 2 or 3, or a water-soluble inorganic alkaline agent selected from the group consisting of alkali metal hydroxides, alkali metal polyphosphates, alkali metal silicates, alkali metal metasilicates, alkali metal carbonates and alkali metal phosphates, or mixtures thereof, (C) from 0.1 to 10% by weight of a water-soluble organic anionic surface active agent selected from the group consisting of olefin ($C_{10}$ to $C_{20}$) sulfonates, alkyl ($C_{10}$ to $C_{20}$) sulfates, alkane ($C_{10}$ to $C_{20}$) sulfonates, alkyl ($C_8$ to $C_{10}$) benzene sulfonates and alkyl ($C_{10}$ to $C_{20}$) ether sulfates containing one to 10 moles of ethylene oxide, a water-soluble organic non-ionic surface active agent selected from the group consisting of polyoxyethylene nonylphenyl ethers containing 4 to 20 moles of ethylene oxide, polyoxyethylene dodecylphenyl ethers containing 4 to 20 moles of ethylene oxide, n-, iso- and sec-higher alcohol ethers of polyoxyethylene having an alkyl chain length of 10 to 18 carbons and containing 4 to 20 moles of ethylene oxide and fatty acid ethanolamides and propanolamides having 10 to 18 carbon atoms, or mixtures thereof, and (D) the balance is essentially water.

2. A detergent composition as set forth in claim 1 wherein the organic phosphoric acid ester (A) consists of tris-2(2-butoxyethoxy) ethyl phosphate or tris-2(2-ethoxyethoxy)ethyl phosphate.

3. A detergent composition as set forth in claim 1 wherein component (B) consists of ammonia or monoethanolamine.

4. A detergent composition as set forth in claim 1 wherein the inorganic alkaline agent is sodium phosphate.

5. A detergent composition as set forth in claim 1 wherein the anionic or non-ionic surface active agent is said alkylbenzene sulfonate, said alkyl ether sulfate, said polyoxyethylene alcohol ether or said fatty acid diethanolamide.

6. A detergent composition according to claim 1 containing from one to 10% by weight of (A), from one to 20% by weight of (B) and from 0.1 to 10% by weight of (C).

7. A detergent composition according to claim 1 containing from 0.1 to 10% by weight of (A), from 0.1 to 1.0% by weight of (B) and from 0.1 to 0.5% by weight of (C).

8. A detergent composition according to claim 1, in which component (B) is selected from the group consisting of monoethanolamine, diethanolamine, triethanolamine, monoisopropanolamine, diisopropanolamine and triisopropanolamine.

9. A detergent composition according to claim 1 in which said water-soluble inorganic alkaline agent is selected from the group consisting of sodium hydroxide, potassium hydroxide, sodium polyphosphate, sodium silicate, sodium metasilicate, sodium carbonate and sodium phosphate.

10. A detergent composition according to claim 1 in which component (B) consists of ammonia or alkanolamine having the formula (II).

11. A detergent composition according to claim 1 in which component (C) consists of said water-soluble organic anionic surface active agent.

* * * * *